US007721690B2

(12) United States Patent
Liu et al.

(10) Patent No.: US 7,721,690 B2
(45) Date of Patent: May 25, 2010

(54) VALVE ACTUATION MECHANISM

(75) Inventors: Ta-Chuan Liu, Taipei (TW); Pan-Hsiang Hsieh, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 503 days.

(21) Appl. No.: 11/785,372

(22) Filed: Apr. 17, 2007

(65) Prior Publication Data

US 2008/0035082 A1 Feb. 14, 2008

(30) Foreign Application Priority Data

Aug. 8, 2006 (TW) ..... 95128974 A

(51) Int. Cl.
*F01L 9/02* (2006.01)

(52) U.S. Cl. ..... 123/90.12; 123/90.16; 123/90.44

(58) Field of Classification Search ..... 123/90.16, 123/90.44, 90.12, 90.27
See application file for complete search history.

(56) References Cited

U.S. PATENT DOCUMENTS 4,523,550 A 6/1985 Honda et al.
4,537,165 A 8/1985 Honda et al.
4,656,977 A 4/1987 Nagahiro et al.
4,727,831 A 3/1988 Nagahiro et al.
4,759,322 A 7/1988 Konno
4,887,563 A 12/1989 Ishida et al.
5,601,057 A * 2/1997 Treyz et al. ..... 123/90.16

FOREIGN PATENT DOCUMENTS

CN 1508399 A 6/2004
JP 3253045 B2 2/2002
TW 366956 7/1999
TW 576888 B 2/2004
WO WO-2006/014662 A1 2/2006

* cited by examiner

*Primary Examiner*—Zelalem Eshete
(74) *Attorney, Agent, or Firm*—Birch, Stewart, Kolasch & Birch, LLP

(57) ABSTRACT

A valve actuation mechanism are disclosed, which is capable of controlling the lift of valves of an engine by more than three on/off combinations. In a preferred embodiment of the invention, the valve actuation mechanism is designed to control the opening and closing of engine valves by the use of an uncomplicated structure with minimum solenoid valves and hydraulic lines. By the valve actuation mechanism of the invention, not only the design of hydraulic line as well as that of space mechanism of an engine can be greatly simplified, but also the opening and closing of valves of an engine can be controlled thereby for enabling the engine to provide different valve lifts and thus satisfying different engine requirements, such as output power increasing, combustion efficiency improving, or cylinder deactivation.

10 Claims, 9 Drawing Sheets

| First connecting unit | Second connecting unit | Pc | Pb | Pa | Solenoid valve 40 | Solenoid valve 41 | Left valve 10 | Right valve 11 | Status |
|---|---|---|---|---|---|---|---|---|---|
| Right | Left | on | off | off | on(staggered) | off(right) | High lift | High lift | High-power output |
| Left | Left | off | on | off | off(straight) | off(right) | Low lift | High lift | Swirl |
| Right | Right | on | off | on | on(staggered) | on(left) | close | close | Deactivation |
| Left | Left | off | off | off | off(straight) | off(right) | Low lift | High lift | Stall |

FIG. 1E

| Power transmission unit | First connecting unit | Second connecting unit | Pc | Pb | Pa | Solenoid valve 50 | Solenoid valve 51 | Left valve 20 | Right valve 21 | Status |
|---|---|---|---|---|---|---|---|---|---|---|
| down | connect | connect | off | on | off | on(staggered) | off(straight) | High lift | High lift | High-power output |
| up | separate | connect | on | off | off | off(straight) | off(straight) | Low lift | High lift | Swirl |
| down | connect | separate | off | off | on | off(straight) | on(staggered) | close | close | Deactivation |
| up | separate | connect | off | off | off | off(straight) | off(straight) | close | High lift | Stall |

FIG. 2E

| Power transmission unit | First connecting unit | Second connecting unit | Pc | Pb | Pa | Solenoid valve 60 | Solenoid valve 61 | Left valve 30 | Right valve 31 | Status |
|---|---|---|---|---|---|---|---|---|---|---|
| up | connect | connect | off | on | off | on | off | High lift | High lift | High-power output |
| up | separate | connect | off | off | off | off | off | Low lift | High lift | Swirl |
| down | separate | separate | on | off | on | off | on | close | close | Deactivation |
| up | separate | connect | off | off | off | off | off | Low lift | High lift | Stall |

FIG. 3D

VALVE ACTUATION MECHANISM

FIELD OF THE INVENTION

The present invention relates to a valve actuation mechanism, and more particularly, to a valve actuation mechanism designed with simplified structure and oil circuit that is capable of selectively controlling the lift of valves of an engine by more than three on/off combinations.

BACKGROUND OF THE INVENTION

With the ever-increasing oil price, fuel economic efficiency and fuel-saving potentials of an engine are becoming more and more important. Recently, most fuel-saving researches are focused upon developing variable valve actuation mechanism since it is the foundation of various fuel-saving techniques, such as cylinder deactivation, engine down-sizing, and so on.

Fuel-saving can be achieved by changing valves' lift, which is realized by methods listed as following:

(1) Designing intake valves to synchronously enable a high or a low lift selected with respect to engine speeds: The valve lifts of two intake valves of an engine are optimized for matching the same with the engine speed, by which high valve lift is adopted for enhancing intake efficiency and thus helping to develop high-power output with less fuel consumption when the engine is operating at high speeds, and low valve lift is adopted when the engine is operating at low/median speeds for reducing fuel consumption since the intake flow speed is increased, the driving torque of camshaft is reduced and the combustion of the engine at idle is stabilized. The aforesaid design is commonly being adopted by Honda and used in its products, such as CIVIC and ACCORD. In addition, The Valvetronic system of BMW is the first variable valve timing system to offer continuously variable intake valve lift for optimizing the performance of engines.

(2) Designing one of two intake valves to enable a high lift while another enabling a low lift: Such design basically allows only one intake valve to be opened for intaking air when an engine is operating at a low/median speed, by which an intense swirl can be created inside its cylinder so as to improve combustion efficiency and thus improve fuel consumption. It is noted that when the engine is operating at high speeds, both of the two intake valves are enabled to perform at a high valve lift. The CB400F of Honda is the representative of such design. However, in order to avoid fuel from depositing at the closed intake valve when the engine is operating at a low/median speed and thus cause troubles, such as incorrect air/fuel ratio and carbon deposition, one intake valve is enabled with a high lift while another is enabled with a low lift.

(3) Deactivating partial valves from intaking: For large-volume engine or hybrid engine, it is preferred to reduce pump loss during cylinder deactivation that can be achieved by designing valves of a portion of a cylinder to be closed when the engine is operating at low speed. The Insight of Honda is the representative of such design.

Currently, there are various researches relates to valve lift control. One such research is disclosed in U.S. Pat. No. 4,523,550, which uses a valve actuation mechanism with adjustable valve disabling device for valve lift control, and is the design capable of enabling one of two intake valves with a high lift while another with a low lift, or enabling only one valve is opened while another is closed. Another such research is disclosed in U.S. Pat. No. 4,727,831, which uses the combinations of three cams and three rocker arms for controlling two valves capable of selectively operating in two operation modes, that is, enabling both valves with a high lift synchronously or enabling one of two intake valves with a high lift while another with a low lift. Further another such research is disclosed in U.S. Pat. No. 4,887,563, which uses the combinations of three cams and three rocker arms for controlling two valves capable of selectively operating in three operation modes, that is, enabling both valves with a high lift synchronously, or enabling one of two intake valves with a high lift while another with a low lift, or enabling one of two intake valves with a median lift while another with a low lift.

Although methods and apparatuses disclosed in the aforesaid patents are all capable of providing multiple operation modes of valve lift, they are all short for providing valve lift control capable of meeting every operation requirement of an engine as it is operating at a high speed for high-power output, or as it is operating at a median speed and requiring an vertex inside its cylinder for improving combustion efficiency, or as it is subject to a cylinder deactivation condition, or as it is stalled. Therefore, it is in need of a valve actuation mechanism that is freed from the shortcomings of prior arts.

SUMMARY OF THE INVENTION

It is the primary object of the present invention to provide a valve actuation mechanism, capable of controlling two intake valves of a cylinder to selectively operate in three operation modes, that is, enabling both valves with a high lift synchronously, or enabling one of two intake valves with a high lift while another with a low lift, or enabling both of two intake valves to close, that respectively satisfy different engine requirements, such as the engine is operating at a high speed for high-power output, as the engine is operating at a median speed and requiring an vertex inside its cylinder for improving combustion efficiency, and as the engine is subject to a cylinder deactivation condition.

It is another object of the invention to provide a valve actuation mechanism, capable of using combinations enabled by a switch pin device, no more than three oil circuits, and no more then two solenoid valves for controlling two intake valves of a cylinder to selectively operate in three operation modes, that is, enabling both valves with a high lift synchronously, and enabling one of two intake valves with a high lift while another with a low lift, and enabling both of two intake valves to close.

Yet, another object of the invention is to provide a low-cost valve actuation mechanism by the use of an uncomplicated structure with minimum oil circuit control.

Furthermore, another object of the invention is to provide a valve actuation mechanism, capable of using no more than three oil circuits and less then two solenoid valves for controlling valves of a cylinder to selectively operate in at least three operation modes, including enabling both valves with a high lift synchronously, and enabling one of two intake valves with a high lift while another with a low lift, and enabling both of two intake valves to close.

To achieve the above objects, the present invention provides a valve actuation mechanism, comprising: a first rocker arm, connect to a first valve; a second rocker arm, connected to a second valve; a first tappet, arranged at a side of the first rocker arm for enabling the same to be driven to move by a first cam; a second tappet, arranged at a side of the second rocker arm for enabling the same to be driven to move by a second cam; a first connecting unit, capable of selectively coupling the first rocker arm to the first tappet or the second rocker arm; and a second connecting unit, capable of selectively enabling the second rocker arm to connect to/separate from the second tappet.

Preferably, any one of the first and the second connecting units can be a switch pin device composed of an elastic member and a hydraulic-driven unit. In addition, the switch pin device is substantially being a device selected from the group consisting of a lock pin and an unlock pin. Moreover, any one of the first and the second connecting units can be a two-way hydraulic-driven pin.

In addition, to achieve the above objects, the present invention provides a valve actuation mechanism, comprising: a first rocker arm, connect to a first valve, capable of being driven to move by a first cam; a second rocker arm, connected to a second valve; a tappet, arranged at a position between the first and the second rocker arms, capable of being driven to move by a second cam; a first connecting unit, capable of selectively enabling the first rocker arm to connect to/separate from the tappet; and a second connecting unit, capable of selectively enabling the second rocker arm to connect to/separate from the tappet.

Preferably, the valve actuation mechanism further comprises: a power transmission unit, mounted on the first rocker arm at a position enabling the same to be sandwiched between the first rocker arm and the first cam and thus enabling power transmitted from the first cam to be received by the first rocker arm; wherein the power transmission unit further comprises: a can, having a throttling hole and a via hole formed thereon while enabling an accommodation space to be formed between the throttling hole and the via hole; a top pin, arranged in the via hole in a manner that an end of the top pin is oriented corresponding to the first cam while enabling the top pin to slide up and down the via hole; and an oil circuit control unit, connected to the throttling hole, capable of selectively performing a task selected from the group consisting of: filling an oil inside the accommodation space and enabling the oil containing in the accommodation space to be released.

In another preferred aspect, the valve actuation mechanism further comprises: a power transmission unit, sandwiched between the first rocker arm and the first cam for enabling power transmitted from the first cam to be received by the first rocker arm. The power transmission unit further comprises: a base, having a first accommodation space, a second accommodation space and a hydraulic channel containing a liquid; a first top pin with a recess formed at a side thereof, being arranged inside the first accommodation space while enabling the bottom thereof to connected to a first elastic member; and a second top pin, being arranged inside the second accommodation space while enabling a portion thereof to have connect with the hydraulic channel and the bottom thereof to connect to a second elastic member; wherein, an end of the second top pin is enabled to embed into/detach from the recess selectively by the action of the second elastic member and the liquid.

Other aspects and advantages of the present invention will become apparent from the following detailed description, taken in conjunction with the accompanying drawings, illustrating by way of example the principles of the present invention.

BRIEF DESCRIPTION OF THE DRAWINGS

FIG. 1E is a table showing various valve lift controls with respect to different settings of the valve actuation mechanism of FIG. 1A.

FIG. 2E is a table showing various valve lift controls with respect to different settings of the valve actuation mechanism of FIG. 2A.

FIG. 3D is a table showing various valve lift controls with respect to different settings of the valve actuation mechanism of FIG. 3A.

DESCRIPTION OF THE PREFERRED EMBODIMENT

For your esteemed members of reviewing committee to further understand and recognize the fulfilled functions and structural characteristics of the invention, several preferable embodiments cooperating with detailed description are presented as the follows.

It is intended to provide a valve actuation mechanism in the present invention, that is capable of controlling two intake valves of a cylinder to selectively operate in at least three operation modes, that is, enabling both valves with a high lift synchronously, or enabling one of two intake valves with a high lift while another with a low lift, or enabling both of two intake valves to close, that respectively satisfy different engine requirements, such as the engine is operating at a high speed for high-power output, as the engine is operating at a median speed and requiring an vertex inside its cylinder for improving combustion efficiency, and as the engine is subject to a cylinder deactivation condition. In addition, the foregoing at least three valve lift controls are realized by using no more than three oil circuits and less then two solenoid valves.

Figure 1B:
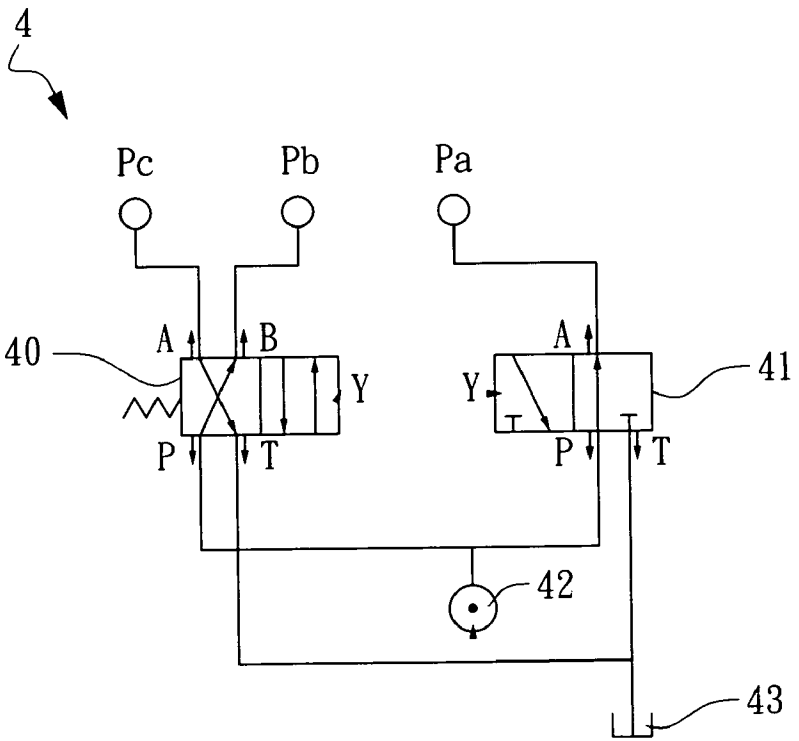
FIG. 1B is a schematic diagram illustrating the oil circuit control of FIG. 1A.
Figure 1A:
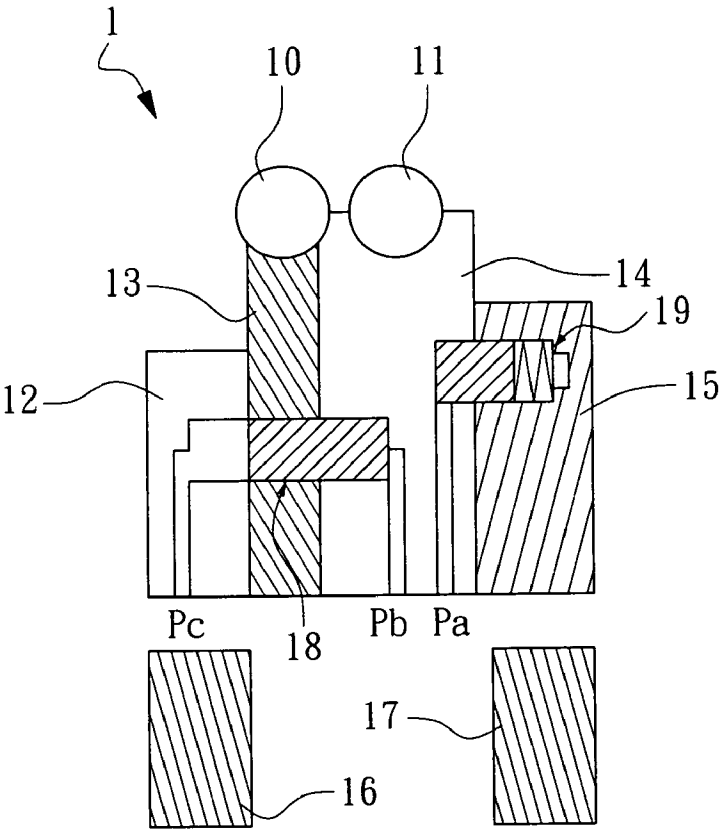
FIG. 1A is a schematic diagram showing a valve actuation mechanism according to a first embodiment of the invention.

Please refer to FIG. 1A, which is a schematic diagram showing a valve actuation mechanism according to a first embodiment of the invention. The valve actuation mechanism 1 of FIG. 1A is comprised of a first rocker arm 13, a second rocker arm 14, a first tappet 12, a second tappet 15, a first connecting unit 18 and a second connecting unit 19. In which, the first rocker arm 13 is connect to a first valve 10 while the second rocker arm 14 is connected to a second valve 11. In a preferred aspect, the first and the second valves 10, 11 are valves arranged on an engine cylinder that are capable of controlling the intake of the cylinder by the lift thereof. It is noted that the arrangement of the first and the second valves 10, 11 on the cylinder are known to those skilled in the art and thus are not described further herein.

The first tappet 12 is arranged at a side of the first rocker arm 13 for enabling the same to be driven to move by a first cam 16 while a second tappet 15 is arranged at a side of the second rocker arm 14 for enabling the same to be driven to move by a second cam 17. In addition, the first cam 16 and the second cam 17 are all being driven to rotate by the rotation of a camshaft. In the first preferred embodiment of the invention, the first cam 16 is a Mid cam and the second cam 17 is a High cam, that is, the moving distance of the first tappet 12 caused by the first cam 16 is smaller than that of the second tappet 15 caused by the second cam 17. Moreover, the first connecting unit 18, which is a two-way hydraulic-driven pin, is capable of selectively coupling the first rocker arm 13 to the first tappet 12 or the second rocker arm 14; and the second connecting unit 19, which is a lock pin, is capable of selectively enabling the second rocker arm 14 to connect to/separate from the second tappet 15.

Figure 1D:
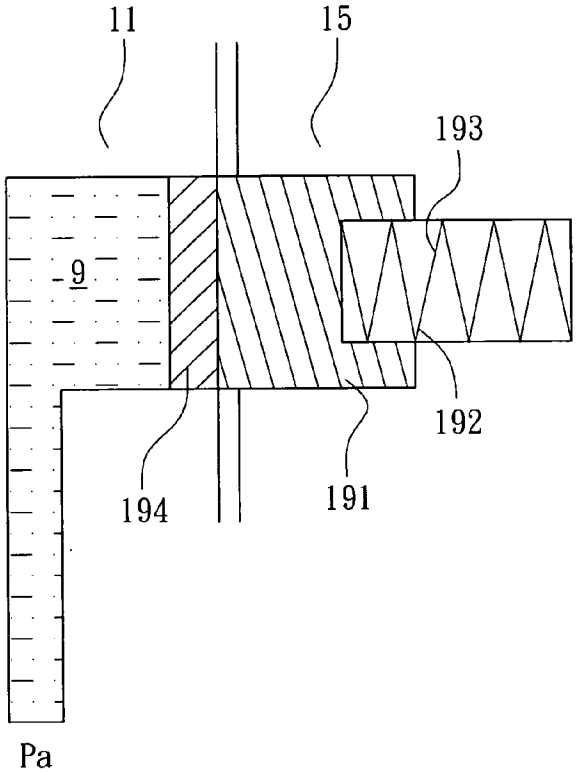
FIG. 1D shows a lock pin used in a valve actuation mechanism of the invention.
Figure 1C:
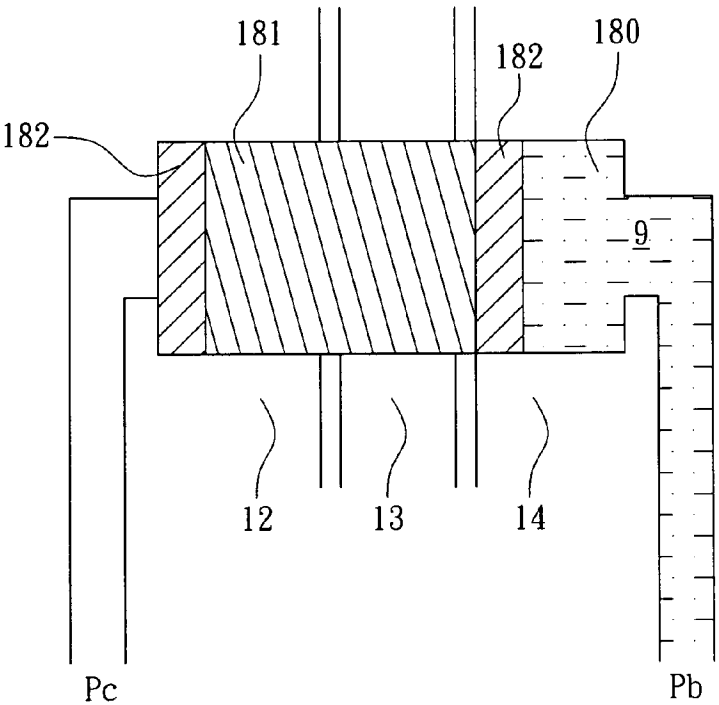
FIG. 1C shows a two-way hydraulic-driven pin used in a valve actuation mechanism of the invention.

Please refer to FIG. 1C and FIG. 1D, which respectively shows a two-way hydraulic-driven pin and a lock pin used in a valve actuation mechanism of FIG. 1A. In FIG. 1C, an accommodation space 180 is formed inside the two-way hydraulic-driven pin, whereas a plug 181, having two oil baffle pads respectively attached to the two ends thereof, is arranged in the accommodation space 180. As the accommodation space 180 is channeled with two oil circuits Pc and Pb, the plug 181 can be driven to move/slide in the accommodation space 180 by the pressure of the oil 9 caused by the activations of the two oil circuits Pc and Pb. As the plug 181 is driven to move to the left of the accommodation space 180, the first rocker arm 13 is connected to the first tappet 12, and as the plug 181 is driven to move to the right of the accommodation space 180, the first rocker arm 13 is connected to the second rocker arm 14. So that, the first connecting unit 18 is capable of selectively coupling the first rocker arm 13 to the first tappet 12 or the second rocker arm 14. As seen in FIG. 1A, when the oil circuit Pc is activated for enabling the oil pressure of Pc to be higher than that of the Pb, the plug 181 is driven to move to the right of the accommodation space 180 and thus the first rocker arm 13 is connected to the second rocker arm 14; and when the oil circuit Pb is activated for enabling the oil pressure of Pb to be higher than that of the Pc, the plug 181 is driven to move to the left of the accommodation space 180 and thus the first rocker arm 13 is connected to the first tappet 12.

As seen in FIG. 1D, the lock pin is substantially a plug 191 with a accommodation space 192 formed therein. In addition, an elastic member 193 is arranged in the accommodation space 192, whereas an end of the elastic member 193 is abutted against the inner wall of the plug while another end thereof is connected to a sidewall. Moreover, an oil baffle pad 194 is attached to an end of the plug 194 while an end of the lock pin corresponding to such end is connect to an oil circuit Pa. Therefore, as the oil circuit Pa is activated for filling oil 9 into the lock pin, the pressurized oil 9 will push the oil baffle pad 194 and thus force the plug 191 to move to the right, so that the elastic member 193 will be compressed and thus a resilience force of the elastic member 193 is accumulated. When the oil circuit Pa is deactivated and thus the oil pressure exerting on the plug 191 is released, the accumulated resilience force of the elastic member 193 will force the plug 191 to move to the left. As seen in FIG. 1A, by the movement of the lock pin, the second rocker arm 14 is capable of selectively being enabling to connect to or separate from the second tappet 15.

Please refer to FIG. 1B, which is a schematic diagram illustrating the oil circuit control of FIG. 1A. In FIG. 1B, an oil circuit control unit is designed and used for controlling the activations of the three oil circuits Pa, Pb, Pc. As seen in FIG. 1B, two four-port two-way solenoid valves 40, 41 are used, in which the two ports, referring as A port and B port, are used as interfaces for connecting to working circuits, i.e. used for connecting to the three oil circuits Pa, Pb, Pc; and the port, referring as P port, is acting as pressure interface that is connected to a pump 42; and the port, referring as T port, is acting as a drain interface and is connected to an oil tank 43. Moreover, a node indicated as a Y node on FIG. 1B is a joint connecting to a control valve.

As seen in FIG. 1E, by the control of the three oil circuit Pa, Pb, Pc, a variety of connection statuses can be enabled through the first and the second connecting units 18, 19 that correspondingly various valve lifts of the first and the second valves 10, 11 can be realized. For instance, in FIG. 1A, the first connecting unit 18 is enabled to connect the first rocker arm 13 with the second rocker arm 14 while the second connecting unit 19 is enabled to connect the second rocker arm 14 with the second tappet 15. Therefore, when the first tappet 12 is driven to move by the rotation of the first cam 16, the movement of the first tappet 12 will be a stand along movement since the first connecting unit 18 is not connected to the first tappet 12.

However, when the second tappet 12 is driven to move by the rotation of the second cam 17, the movement of the second tappet 15 will drive the second connecting unit 19 and therefore the first connecting unit 18 to move, and consequently the first rocker arm 13 the second rocker arm 14 are being driven to move as well since the second tappet 15 are connected to the second rocker arm 14 by the second connecting unit 19 while the second rocker arm 14 are connected to the first rocker arm 13 by the first connecting unit 18. In this preferred embodiment, the second cam 17 is a high cam, so that the first valve 10 and the second valve 11 are both being enabled with a high valve lift. Hence, under the same principle, other valve lift controls with respect to different settings of the valve actuation mechanism of FIG. 1A can be seen in the table shown in FIG. 1E. As seen in FIG. 1E, the engine can produce a high-power output when the valve actuation mechanism enables both of the two valves 10, 11 with a high lift; an status of engine deactivation is enabled when both of the two valves 10, 11 are closed; and the engine is enabled to produce an intense swirl inside its cylinder or is stalled when one of two intake valves 10, 11 is enabled with a high lift while another with a low lift.

Figure 2B:
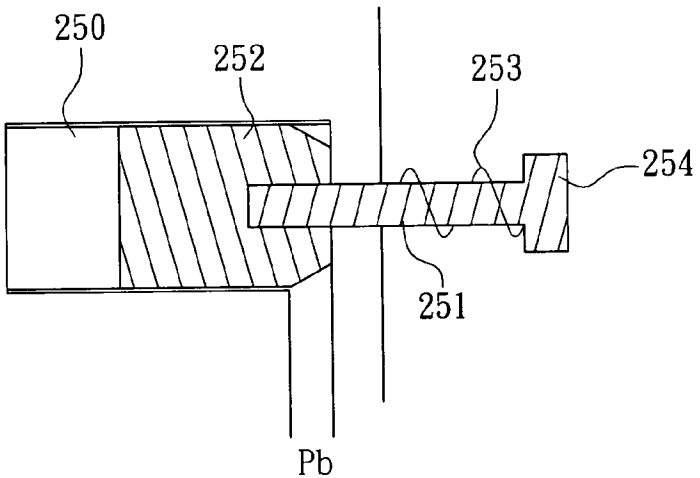
FIG. 2B shows an unlock pin used in a valve actuation mechanism of the invention.
Figure 2A:
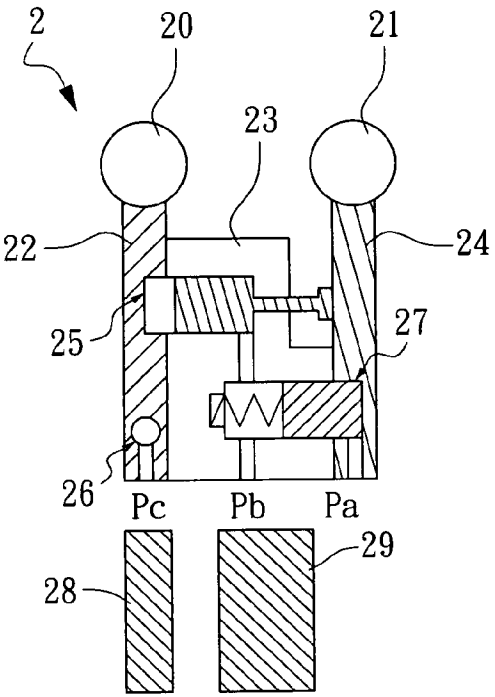
FIG. 2A is a schematic diagram showing a valve actuation mechanism according to a second embodiment of the invention.

Please refer FIG. 2A, which is a schematic diagram showing a valve actuation mechanism according to a second embodiment of the invention. The valve actuation mechanism 2 of FIG. 2A is comprised of a first rocker arm 22, a second rocker arm 24, a tappet 23, a first connecting unit 25 a second connecting unit 27 and a power transmission unit 26. In which, the first rocker arm 22, being connect to a first valve 20, is capable of being driven to move by a first cam 28 while the second rocker arm 22 is connected to a second valve 21 for enabling the same to control the lift of the second valve 21. In a preferred aspect, the first and the second valves 20, 21 are valves arranged on an engine cylinder that are capable of controlling the intake of the cylinder by the lift thereof. It is noted that the arrangement of the first and the second valves 10, 11 on the cylinder are known to those skilled in the art and thus are not described further herein. The tappet 23 is sandwiched between the first rocker arm 22 and the second rocker arm 24 that can be driven to move by a second cam 29. In addition, the first cam 28 and the second cam 29 are all being driven to rotate by the rotation of a camshaft. In this preferred embodiment of the invention, the first cam 28 is a Mid cam and the second cam 29 is a High cam, that is, the moving distance of the first rocker arm 22 caused by the first cam 28 is smaller than that of the second rocker arm 24 caused by the second cam 29.

Moreover, the first connecting unit 25, which is an unlock pin, is capable of selectively enabling the first rocker arm 22 to connect to/separate from the tappet 23. Please refer to FIG. 2B, which shows an unlock pin used in a valve actuation mechanism of FIG. 2A. The unlock pin of FIG. 2B has an accommodation space 250 used for receiving a plug 252 while enabling an end of the accommodation space 250 to channel with an oil circuit Pb. In addition, a rod 251 connected to the plug 252 is extending out of the accommodation space 250 and thus out of the unlock pin, whereas a blocking panel 254 is attached to the out-extending end of the rod 251 while enabling the section of the rod 251 between the blocking panel 254 and the outer wall of the unlock pin to be ensheathed by an elastic member 253.

Therefore, as the oil circuit Pb is activated for exerting a pressure upon the plug 252, the plug 252 will be push to move toward the left for compressing the elastic member 253 and thus a resilience force of the elastic member 193 is accumulated. When the oil circuit Pb is deactivated and thus the oil pressure exerting on the plug 252 is released, the accumulated resilience force of the elastic member 253 will force the plug 252 to move to the right. As seen in FIG. 2A, by the movement of the unlock pin controlled by the oil circuit Pb and the elastic member 253, the first rocker arm 22 is capable of selectively enabling the first rocker arm 22 to connect to or separate from the tappet 23. Similarly, the second connecting unit 27 is capable of selectively enabling the second rocker arm 24 to connect to or separate from the tappet 23. In this preferred embodiment, the second connecting unit 27 is a lock pin, whose operational principle is illustrated with respect to FIG. 1D and thus is not described further herein.

Figure 2D:
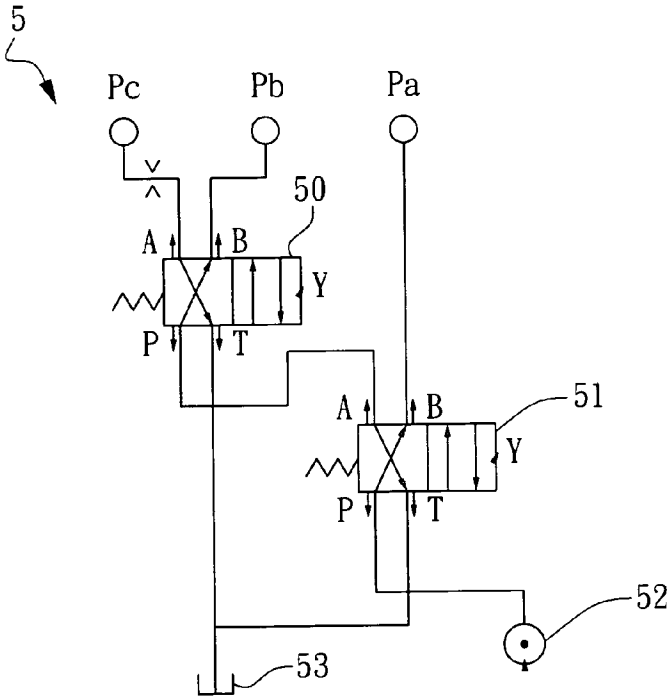
FIG. 2D is a schematic diagram illustrating the oil circuit control of FIG. 2A.
Figure 2C:
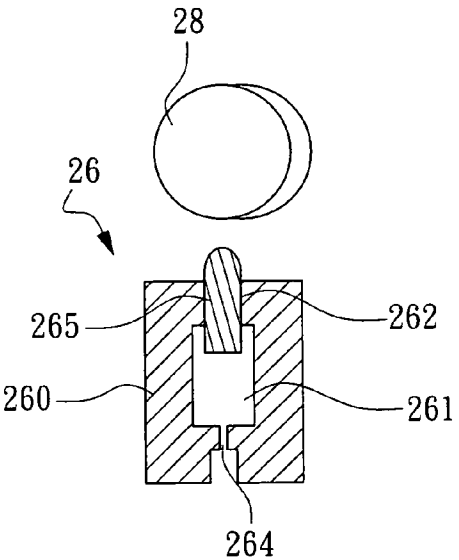
FIG. 2C is a schematic diagram showing a power transmission unit adopted by the valve actuation mechanism of FIG. 2A.

Please refer to FIG. 2C, which is a schematic diagram showing a power transmission unit adopted by the valve actuation mechanism of FIG. 2A. The power transmission unit 26, being mounted on the first rocker arm 22, is comprised of a can 260, a top pin 265 and an oil circuit control unit. The can 260 has a throttling hole 264 and a first via hole 262 formed thereon while enabling an accommodation space 261 to be formed between the throttling hole 264 and the first via hole 262. the top pin 265 is arranged in the first via hole 262 in a manner that an end of the top pin 265 is oriented corresponding to the first cam 28 while enabling the top pin 265 to slide up and down the first via hole 262.

Moreover, the oil circuit control unit is connected to the throttling hole 264 and is capable of selectively performing a task selected from the group consisting of: filling an oil inside the accommodation space 261 for pressurizing the top pin to move upwardly and enabling the oil containing in the accommodation space 261 to be released for causing the top pin 265 to move downwardly. If the top pin 265 is moved upward, the power of the first cam 28 can be received by the power transmission unit 26 and then transmitted to the first rocker arm 22 for enabling the same to move accordingly. As the diameter of the throttling hole 264 is specifically designed and specified, the oil containing in the accommodation space 261 will not leak even when the first cam 28 bangs on the top pin 265. Thus, the power transmission unit 26 is considered to have good rigidity by the incompressibility of the oil. For instance, an throttling hole 264 with smaller than 2 mm diameter will enabling the power transmission unit 26 to sustain a force of 200N from the first cam 28. If the oil containing in the accommodation space 261 is released and the top pin 265 is dropped, the driving force of the first cam 28 will not be received by the first rocker arm 22. There is an oil circuit control illustrated in FIG. 2D, however, it is only an illustration and the present invention is not limited thereby.

Please refer to FIG. 2D, which is a schematic diagram illustrating the oil circuit control of FIG. 2A. In FIG. 2D, an oil circuit control unit 5 is designed and used for controlling the activations of the three oil circuits Pa, Pb, Pc. As seen in FIG. 2D, two four-port two-way solenoid valves 50, 51 are used, in which the two ports, referring as A port and B port, are used as interfaces for connecting to working circuits, i.e. used for connecting to the three oil circuits Pa, Pb, Pc; and the port, referring as P port, is acting as pressure interface that is connected to a pump 52; and the port, referring as T port, is acting as a drain interface and is connected to an oil tank 53. Moreover, a node indicated as a Y node on FIG. 1B is a joint connecting to a control valve.

As seen in FIG. 2E, by the control of the three oil circuit Pa, Pb, Pc, a variety of connection statuses can be enabled through the first and the second connecting units 25, 27 that correspondingly various valve lifts of the first and the second valves 20, 21 can be realized. For instance, referring to FIG. 2A and FIG. 2C, when the oil circuit Pc is exerting a pressure upon the power transmission unit 26 for forcing the top pin 265 to raise, and the same time that the first connecting unit 25 is enabled to separate the first rocker arm 22 from the tappet 23 while the second connecting unit 27 is enabled to separate the second rocker arm 24 from the tappet 23, the rotation power of the first cam 28 will be received by the power transmission unit 26 and then transmitted to the first rocker arm 22, however, the movement of first rocker arm 22 will be a stand along movement since the tappet 23 is not connected to the first rocker arm 22. So that, only the first valve 20 is driven to perform a low lift as the first cam 28 is a Mid cam.

On the other hand, when the second cam 29, being a high cam, is rotating and the tappet 23 is connected to the second rocker arm 24 by the second connecting unit 27, the tappet 23 will be driven to move by the second cam 29 that further brings the second rocker arm 24 to move accordingly through the second connecting unit 27, and eventually enables the second valve 21 with a high lift. Hence, under the same principle, other valve lift controls with respect to different settings of the valve actuation mechanism of FIG. 2A can be seen in the table shown in FIG. 2E.

Figure 3B:
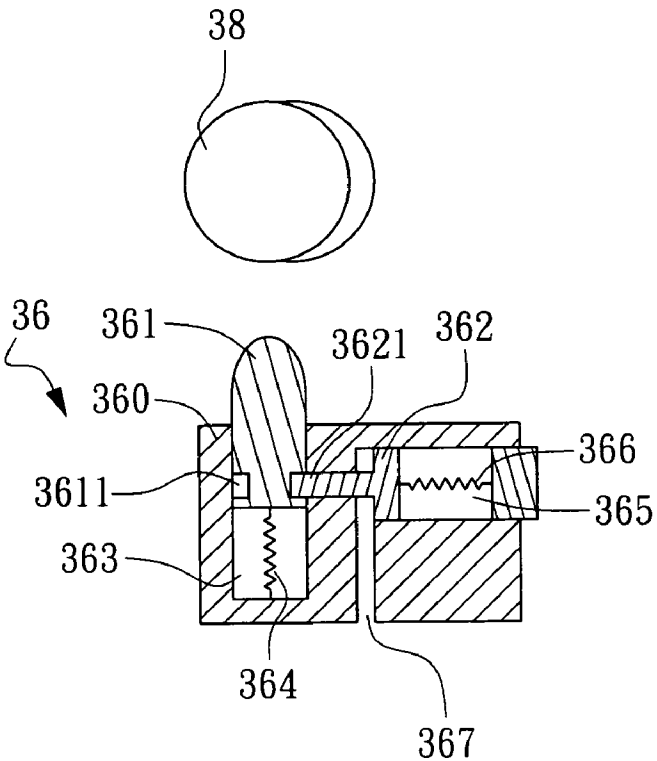
FIG. 3B is a schematic diagram showing a power transmission unit adopted by the valve actuation mechanism of FIG. 3A.
Figure 3A:
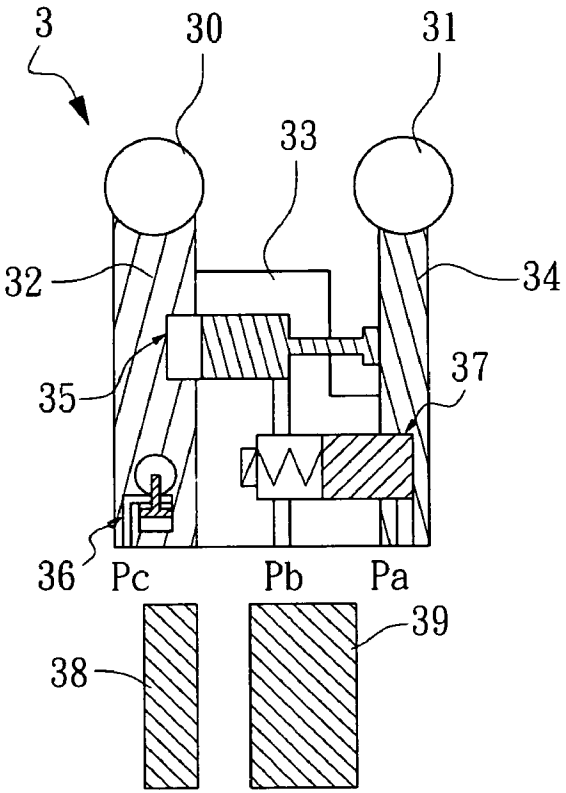
FIG. 3A is a schematic diagram showing a valve actuation mechanism according to a third embodiment of the invention.

Please refer to FIG. 3A, which is a schematic diagram showing a valve actuation mechanism according to a third embodiment of the invention. The valve actuation mechanism 3 of FIG. 3A is comprised of a first rocker arm 32, a second rocker arm 24, a tappet 33, a first connecting unit 35, a second connecting unit 37 and a power transmission unit 36. In which, the first rocker arm 32, being connect to a first valve 30, is capable of being driven to move by a first cam 38 while the second rocker arm 32 is connected to a second valve 31 for enabling the same to control the lift of the second valve 31. The tappet 33 is sandwiched between the first rocker arm 32 and the second rocker arm 34 that can be driven to move by a second cam 39. It is noted that the connecting relations between the first cam 38, the second cam 39, the first rocker arm 32, the second rocker arm 34, the tappet 33, the first connecting unit 35 and the second connecting unit 37 are the same as those illustrated in FIG. 2A and thus are not described further herein.

Please refer to FIG. 3B, which is a schematic diagram showing a power transmission unit adopted by the valve actuation mechanism of FIG. 3A. The power transmission unit 36, being mounted on the first rocker arm 34, is comprised of: a base 360, having a first accommodation space 363, a second accommodation space 365 and a hydraulic channel 367 containing a liquid; a first top pin 361 with a recess 3611 formed at a side thereof, being arranged inside the first accommodation space 363 while enabling the bottom thereof to connected to a first elastic member 364; and a second top pin 362, being arranged inside the second accommodation space 365 while enabling a portion thereof to have connect with the hydraulic channel 367 and the bottom thereof to connect to a second elastic member 366; wherein, an end of the second top pin 362 is enabled to embed into/detach from the recess 3611 selectively by the action of the second elastic member 366 and the liquid. In a preferred aspect, the hydraulic channel 367 is connected to the oil circuit Pc of FIG. 3A.

Operationally, when the first elastic member 364 of the power transmission unit 36 is not subjecting to any external force, the first top pin 361 is raised naturally thereby. Similarly, as not oil pressure is provided by the hydraulic channel 367 and thus the second elastic member 366 will not be subjected to any external force, the second top pin 362 will be pushed by move forward thereby that enable the top 3621 of the second top pin 362 to embed into the recess 3611. By embedding the top 3621 of the second top pin 362 into the recess 3611 of the first top pin 361, the first top pin 361 is fixed to a raised position, by which the first top pin 361 is able to have contact with the first cam 38 so as to transmit the driving force of the first cam 38 to the first rocker arm 32 for driving the same to move. However, when an oil pressure provided by the hydraulic channel 367 force the second top pin 362 to move to the right causing the top 3621 of the second top pin 362 to separate from the recess 3611 and as the rotating first cam 38 is contacting to the first top pin 361, the force of the first cam 38 will be absorbed by the first elastic member 364 since the first top pin 361 is not supported by the second top pin 362 and thus the first rocker arm will not receive any power.

Figure 3C:
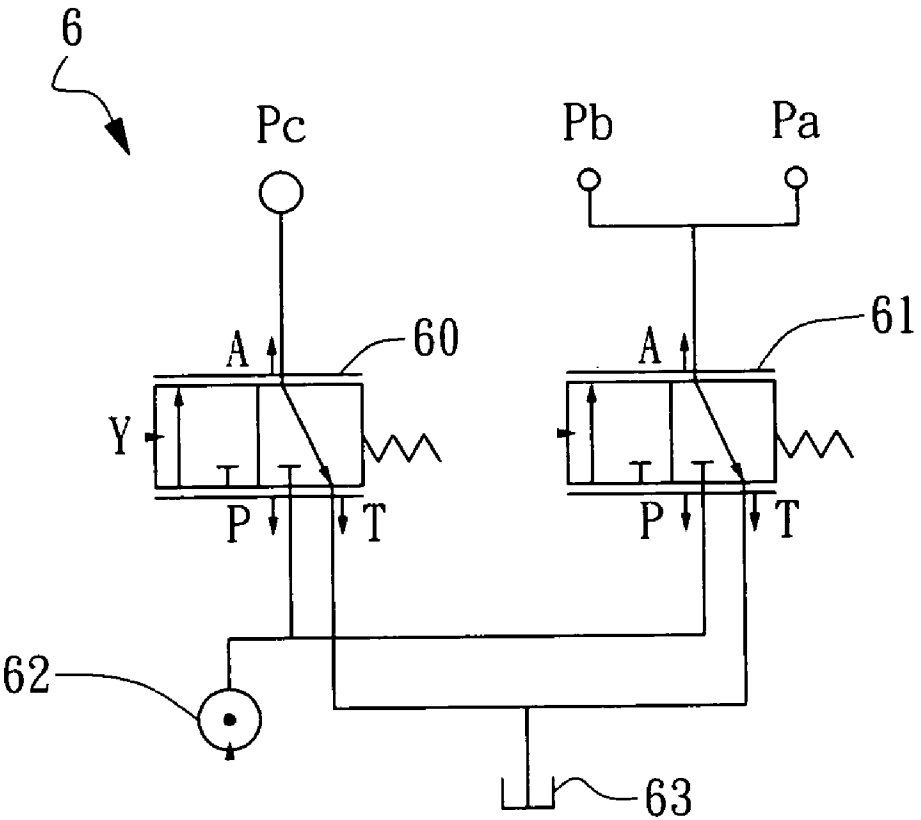
FIG. 3C is a schematic diagram illustrating the oil circuit control of FIG. 3A.

Please refer to FIG. 3C, which is a schematic diagram illustrating the oil circuit control of FIG. 3A. In FIG. 3C, an oil circuit control unit 5 is designed and used for controlling the activations of the three oil circuits Pa, Pb, Pc. As seen in FIG. 2D, two four-port two-way solenoid valves 60, 61 are used, in which the two ports, referring as A port and B port, are used as interfaces for connecting to working circuits, i.e. used for connecting to the three oil circuits Pa, Pb, Pc; and the port, referring as P port, is acting as pressure interface that is connected to a pump 62; and the port, referring as T port, is acting as a drain interface and is connected to an oil tank 63. Moreover, a node indicated as a Y node on FIG. 1B is a joint connecting to a control valve.

As seen in FIG. 3D, by the control of the three oil circuit Pa, Pb, Pc, a variety of connection statuses can be enabled through the first and the second connecting units 35, 37 that correspondingly various valve lifts of the first and the second valves 30, 31 can be realized. For instance, referring to FIG. 3A and FIG. 3C, when the oil circuit Pc is not exerting any pressure upon the power transmission unit 36 so that the first top pin 361 is maintained at a raised position, and the same time that the first connecting unit 25 is enabled to separate the first rocker arm 32 from the tappet 23 since no oil pressure is provided by the oil circuit Pb; moreover, the second connecting unit 37 is enabled to separate the second rocker arm 34 from the tappet 23 also since no oil pressure is provided by the oil circuit Pa, the rotation power of the first cam 38 will be received by the power transmission unit 36 and then transmitted to the first rocker arm 32, however, the movement of first rocker arm 32 will be a stand along movement since the tappet 33 is not connected to the first rocker arm 32. So that, only the first valve 30 is driven to perform a low lift as the first cam 38 is a Mid cam.

On the other hand, when the second cam 39, being a high cam, is rotating and the tappet 33 is connected to the second rocker arm 34 by the second connecting unit 37, the tappet 33 will be driven to move by the second cam 39 that further brings the second rocker arm 34 to move accordingly through the second connecting unit 37, and eventually enables the second valve 31 with a high lift. Hence, under the same principle, other valve lift controls with respect to different settings of the valve actuation mechanism of FIG. 3A can be seen in the table shown in FIG. 3D.

To sum up, the present invention provides a valve actuation mechanism, capable of using no more than three oil circuits and no more then two solenoid valves for controlling valves of a cylinder to selectively operate in at least three operation modes, including enabling both valves with a high lift synchronously, and enabling one of two intake valves with a high lift while another with a low lift, and enabling both of two intake valves to close.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A valve actuation mechanism, comprising:

a first rocker arm, connect to a first valve, capable of being driven to move by a first cam;

a second rocker arm, connected to a second valve;

a tappet, arranged at a position between the first and the second rocker arms, capable of being driven to move by a second cam;

a first connecting unit, capable of selectively enabling the first rocker arm to connect to/separate from the tappet;

a second connecting unit, capable of selectively enabling the second rocker arm to connect to/separate from the tappet; and a power transmission unit, arranged on the first rocker arm at a position corresponding to the first cam for enabling power transmitted from the first cam to be received by the first rocker arm, wherein the power transmission unit further comprises:

a can, having a throttling hole and a via hole formed thereon while enabling an accommodation space to be formed between the throttling hole and the via hole;

a top pin, arranged in the via hole in a manner that an end of the top pin is oriented corresponding to the first cam while enabling the top pin to slide up and down the via hole; and an oil circuit control unit, connected to the throttling hole, capable of selectively performing a task selected from the group consisting of: filling an oil inside the accommodation space and enabling the oil containing in the accommodation space to be released.

2. The valve actuation mechanism of claim 1, wherein the first connecting unit is a switch pin device composed of an elastic member and a hydraulic-driven unit.

3. The valve actuation mechanism of claim 2, wherein the switch pin device is substantially being a device selected from the group consisting of a lock pin and an unlock pin.

4. The valve actuation mechanism of claim 1, wherein the second connecting unit is a switch pin device composed of an elastic member and a hydraulic-driven unit.

5. The valve actuation mechanism of claim 4, wherein the switch pin device is substantially being a device selected from the group consisting of a lock pin and an unlock pin.

6. A valve actuation mechanism, comprising:

a first rocker arm, connect to a first valve, capable of being driven to move by a first cam;

a second rocker arm, connected to a second valve;

a tappet, arranged at a position between the first and the second rocker arms, capable of being driven to move by a second cam;

a first connecting unit, capable of selectively enabling the first rocker arm to connect to/separate from the tappet;

a second connecting unit, capable of selectively enabling the second rocker arm to connect to/separate from the tappet; and a power transmission unit, arranged on the first rocker arm at a position corresponding to the first cam for enabling power transmitted from the first cam to be received by the first rocker arm, wherein the power transmission unit further comprises:

a base, having a first accommodation space, a second accommodation space and a hydraulic channel containing a liquid;

a first top pin with a recess formed at a side thereof, being arranged inside the first accommodation space while enabling the bottom thereof to connected to a first elastic member; and a second top pin, being arranged inside the second accommodation space while enabling a portion thereof to have connect with the hydraulic channel and the bottom thereof to connect to a second elastic member;

wherein, an end of the second top pin is enabled to embed into/detach from the recess selectively by the action of the second elastic member and the liquid.

7. The valve actuation mechanism of claim 6, wherein the first connecting unit is a switch pin device composed of an elastic member and a hydraulic-driven unit.

8. The valve actuation mechanism of claim 7, wherein the switch pin device is substantially being a device selected from the group consisting of a lock pin and an unlock pin.

9. The valve actuation mechanism of claim 6, wherein the second connecting unit is a switch pin device composed of an elastic member and a hydraulic-driven unit.

10. The valve actuation mechanism of claim 9, wherein the switch pin device is substantially being a device selected from the group consisting of a lock pin and an unlock pin.

* * * * *